US009112274B2

(12) United States Patent
Cheng et al.

(10) Patent No.: US 9,112,274 B2
(45) Date of Patent: Aug. 18, 2015

(54) WIRELESS NETWORK RECEIVER

(75) Inventors: Shih-Chieh Cheng, Kaohsiung (TW); Kuo-Chang Lo, Miaoli County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 535 days.

(21) Appl. No.: 13/023,267

(22) Filed: Feb. 8, 2011

(65) Prior Publication Data

US 2011/0193756 A1 Aug. 11, 2011

(30) Foreign Application Priority Data

Feb. 9, 2010 (TW) ..... 99104014 A

(51) Int. Cl.
*H01Q 1/36* (2006.01)
*H01Q 9/42* (2006.01)

(52) U.S. Cl.
CPC ..... *H01Q 9/42* (2013.01)

(58) Field of Classification Search
CPC ..... H01Q 1/36
USPC ..... 343/720
See application file for complete search history.

(56) References Cited

U.S. PATENT DOCUMENTS

| | | | | |
|---|---|---|---|---|
| 3,605,097 | A * | 9/1971 | Hadik-Barkoczy | 343/739 |
| 8,154,470 | B2 * | 4/2012 | Chang et al. | 343/906 |
| 8,217,853 | B2 * | 7/2012 | Tai et al. | 343/906 |
| 2007/0030198 | A1 * | 2/2007 | Wei | 343/700 MS |
| 2007/0268187 | A1 * | 11/2007 | Cheng | 343/700 MS |
| 2009/0167631 | A1 * | 7/2009 | Tai et al. | 343/906 |
| 2010/0067188 | A1 * | 3/2010 | Tanaka | 361/679.33 |
| 2010/0164811 | A1 * | 7/2010 | Cheng et al. | 343/700 MS |
| 2010/0164835 | A1 * | 7/2010 | Tai et al. | 343/906 |

FOREIGN PATENT DOCUMENTS

| | | | |
|---|---|---|---|
| CN | 101036261 | A | 9/2007 |
| CN | 200969391 | Y | 10/2007 |
| CN | 101258641 | A | 9/2008 |
| CN | 201130706 | Y | 10/2008 |
| CN | 101383464 | A | 3/2009 |
| CN | 101553954 | A | 10/2009 |

* cited by examiner

*Primary Examiner* — Dameon E Levi
*Assistant Examiner* — Andrea Lindgren Baltzell
(74) *Attorney, Agent, or Firm* — Rabin & Berdo, P.C.

(57) ABSTRACT

A wireless network receiver includes a circuit board and a connector structure. The connector structure is fixed on the circuit board, and the connector structure includes a connector and an antenna. The antenna, crossing the circuit board, and the connector are integrally formed with as a whole. The antenna includes a feeding connecting member, a horizontal radiator, a vertical radiator and a grounding connecting member. The horizontal radiator generates a horizontally polarized wave and is connected to the feeding connecting member. The vertical radiator generates a vertically polarized wave and is connected to the horizontal radiator. The grounding connecting member connects the horizontal radiator to the connector.

17 Claims, 12 Drawing Sheets

WIRELESS NETWORK RECEIVER

This application claims the benefit of Taiwan application Serial No. 99104014, filed Feb. 9, 2010, the subject matter of which is incorporated herein by reference.

BACKGROUND OF THE INVENTION

1. Field of the Invention

The invention relates in general to a wireless network receiver, and more particularly to a wireless network receiver having a connector and an antenna integrally formed as a whole.

2. Description of the Related Art

With the popularization of the computer apparatus and the flourishing development of the Internet, information exchanges all over the world may be made so that the economic and technological progresses may be obtained. According to the development of the wireless network, the more convenient and human-oriented communication environment may be provided to the user. For example, the user can momentarily login the Internet in a wireless manner through the wireless network receiver to obtain a lot of network information.

The wireless network receiver includes a universal serial bus (USB) and an antenna. The universal serial bus is a standard connection interface frequently used in the wireless network receiver. The wireless network receiver is connected to the computer through the USB. The wireless network receiver transceives wireless signals through the antenna in the wireless manner. The wireless transceiving ability of the antenna directly influences the quality of the wireless network receiver. So, how to design an antenna with the better wireless transceiving ability has become an important issue.

FIG. 1 (Prior Art) is a schematic illustration showing a conventional metal antenna 110. The conventional metal antenna 110 is disposed on a circuit board 120 to provide the ability of transceiving the wireless signals. However, the conventional metal antenna 110 requires the extra cost of manufacturing the mold and the extra assembling cost.

FIG. 2 (Prior Art) is a schematic illustration showing a conventional printed antenna 210. As shown in FIG. 2, the conventional printed antenna 210 is formed on a circuit board 220 to provide the ability of transceiving the wireless signals. However, the conventional printed antenna 210 significantly increases the area of the circuit board 220, and has the long-distance radiation ability worse than that of the conventional metal antenna 110.

FIGS. 3 to 6 (Prior Art) are schematic illustrations respectively showing a conventional connector structure 30 at different angles. Referring to FIGS. 3 to 6, the conventional connector structure 30 includes a connector 320 and an antenna 310. The connector 320 and the antenna 310 are integrally formed as a whole, and the antenna 310 has a vortical shape.

However, the conventional connector structure 10 only can generate the horizontally polarized wave but cannot generate the vertically polarized wave, so that the radiation pattern cannot be extended. In addition, when the antenna 310 of the conventional connector structure 10 neighbors the other connector structure, such as a USB flash memory, having a different function, the antenna 310 is shielded and thus has the poor signal receiving effect. In addition, the complicated structure of the conventional connector structure 10 correspondingly increases the difficulty in manufacturing.

SUMMARY OF THE INVENTION

The invention is directed to a wireless network receiver having many advantages, some of which will be listed in the following.

First, no extra cost for the mold is needed.

Second, no extra assembling cost is needed.

Third, no extra area of the circuit board has to be added.

Fourth, the better radiation pattern is possessed.

Fifth, the structure is simple, and the difficulty in manufacturing is relatively decreased.

According to the present invention, a wireless network receiver is provided. The wireless network receiver includes a circuit board and a connector structure. The connector structure is fixed on the circuit board and includes a connector and an antenna. The antenna, crossing the circuit board, and the connector are integrally formed as a whole. The antenna includes a feeding connecting member, a horizontal radiator, a vertical radiator and a grounding connecting member. The horizontal radiator generates a horizontally polarized wave and is connected to the feeding connecting member. The vertical radiator generates a vertically polarized wave and is connected to the horizontal radiator. The grounding connecting member connects the horizontal radiator to the connector.

Preferably, the horizontal radiator of the antenna is vertically connected to the vertical radiator of the antenna.

Preferably, the circuit board is a dual panel and further includes an upper surface and a lower surface. The upper surface and the lower surface face each other and are parallelly disposed on the circuit board.

Preferably, the antenna crosses the upper surface of the circuit board and is substantially parallel to the upper surface.

Preferably, the horizontal radiator of the antenna crosses the upper surface of the circuit board and is substantially parallel to the upper surface.

Preferably, the plane shape of the horizontal radiator of the antenna is an h-like shape.

Preferably, the antenna extends across the lower surface of the circuit board and is substantially parallel to the lower surface.

Preferably, the vertical radiator of the antenna extends across the lower surface of the circuit board and is substantially parallel to the lower surface.

Preferably, the circuit board further includes a first sidewall, a second sidewall, a third sidewall and a fourth sidewall, wherein the first sidewall and the third sidewall are symmetrically disposed on two lateral sides of the circuit board, and two ends of the second sidewall and two ends of the fourth sidewall are respectively connected to two ends of the first sidewall and two ends of the third sidewall and are symmetrically disposed on the other two lateral sides of the circuit board.

Preferably, the first to fourth sidewalls of the circuit board are vertically connected to the lower surface of the upper surface.

Preferably, the first and third sidewalls of the circuit board are disposed opposite and parallel to each other, and the two ends of the second sidewall and the two ends of the fourth sidewall are vertically connected to the two ends of the first sidewall and the two ends of the third sidewall.

Preferably, the first sidewall of the circuit board neighbors the connector.

Preferably, the antenna extends from one side neighboring the second sidewall of the circuit board and crosses the fourth sidewall, and is substantially parallel to the second sidewall and the fourth sidewall.

Preferably, the feeding connecting member and the grounding connecting member of the antenna neighbor one side of the second sidewall of the circuit board.

Preferably, the vertical radiator of the antenna crosses the fourth sidewall of the circuit board.

Preferably, the fourth sidewall of the circuit board further includes a notch, through which the antenna crosses the fourth sidewall of the circuit board.

Preferably, the vertical radiator of the antenna crosses the fourth sidewall of the circuit board through the notch.

Preferably, the vertical radiator of the antenna is line-shaped.

Preferably, the horizontal radiator of the antenna further includes at least one bend.

Preferably, the vertical radiator of the antenna further includes at least one bend, such that the vertical radiator, after crossing the fourth sidewall of the circuit board, parallelly extends along one side of the fourth sidewall through the bend.

Preferably, the vertical radiator of the antenna further includes at least one bend, such that the vertical radiator, after crossing the fourth sidewall of the circuit board, parallelly extends along the lower surface through the bend.

Preferably, the vertical radiator of the antenna has an L-shape.

Preferably, the connector further includes at least two connecting members, and the surface of the circuit board neighboring the first sidewall further includes a connecting hole corresponding to the connecting member so that the circuit board may be fixed on and combined with the connector.

Preferably, one side of the circuit board neighboring the second sidewall further includes a feeding point electrically connected to the feeding connecting member of the antenna.

Preferably, one side of the circuit board neighboring the second sidewall further includes a grounding point electrically connected to the grounding connecting member of the antenna.

Preferably, the width and the height of the antenna are smaller than or equal to the width and the height of the connector.

The above and other aspects of the invention will become better understood with regard to the following detailed description of the preferred but non-limiting embodiments. The following description is made with reference to the accompanying drawings.

DETAILED DESCRIPTION OF THE INVENTION

First Embodiment

Figure 1:
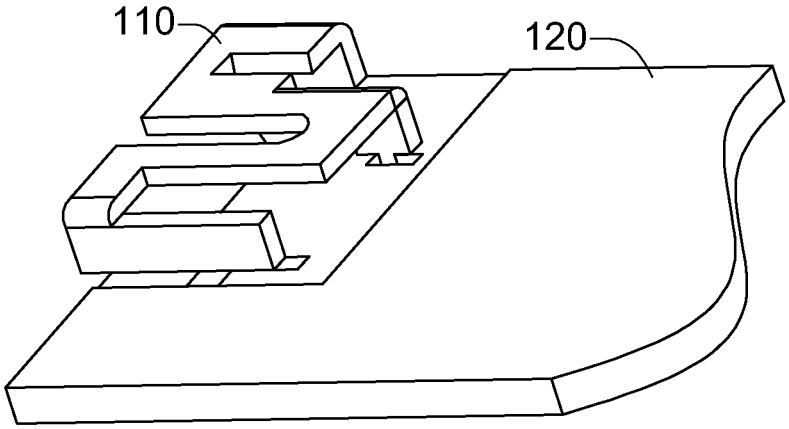
FIG. 1 (Prior Art)
FIG. 1 (Prior Art) is a schematic illustration showing a conventional metal antenna.
Figure 2:
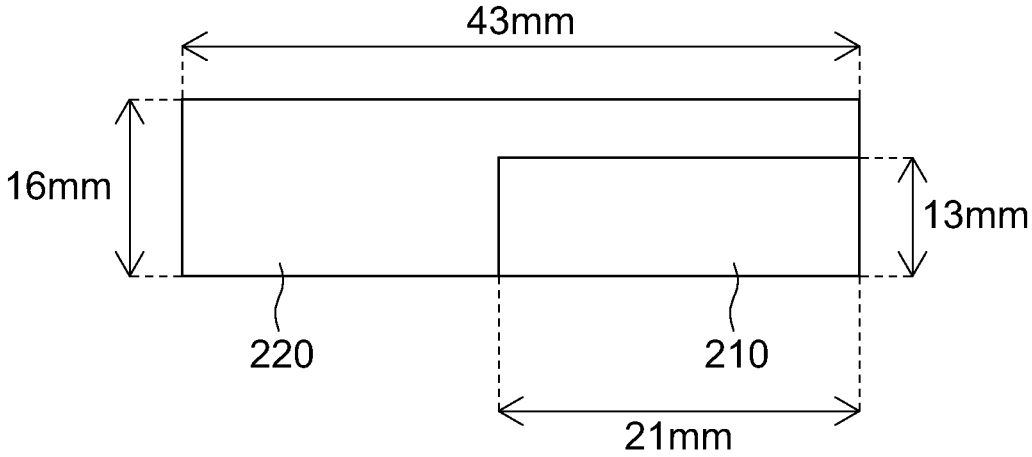
FIG. 2 (Prior Art)
FIG. 2 (Prior Art) is a schematic illustration showing a conventional printed antenna.
Figure 3:
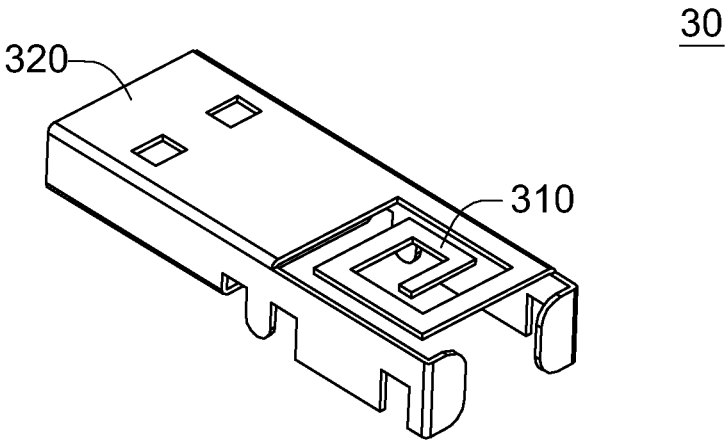
FIG. 3 (Prior Art)
FIGS. 3 to 6 (Prior Art) are schematic illustrations respectively showing a conventional connector structure at different angles.
Figure 4:
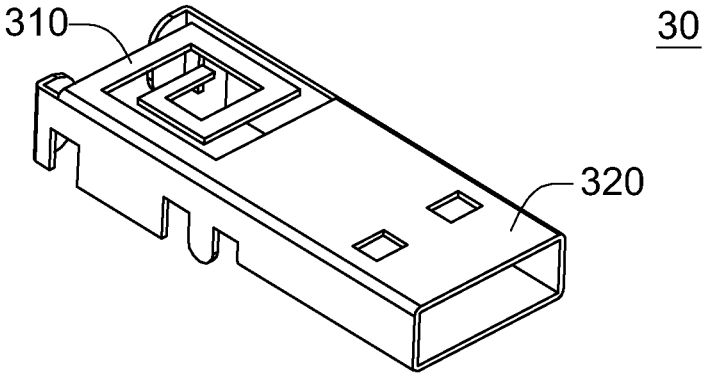
FIG. 4 (Prior Art)
Figure 5:
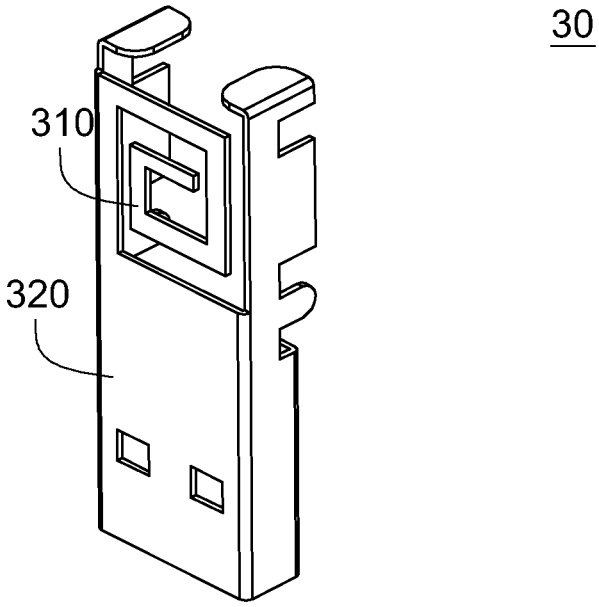
FIG. 5 (Prior Art)
Figure 6:
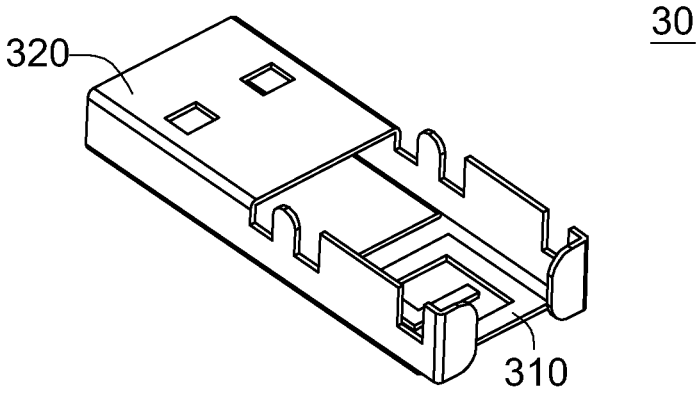
FIG. 6 (Prior Art)
Figure 7:
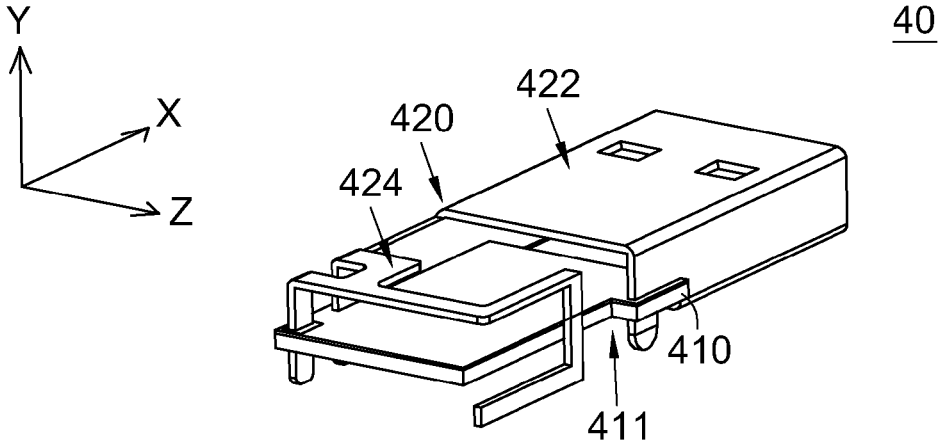
FIGS. 7 and 8 are schematic illustrations respectively showing a wireless network receiver at different angles according to a first embodiment of the invention.
Figure 8:
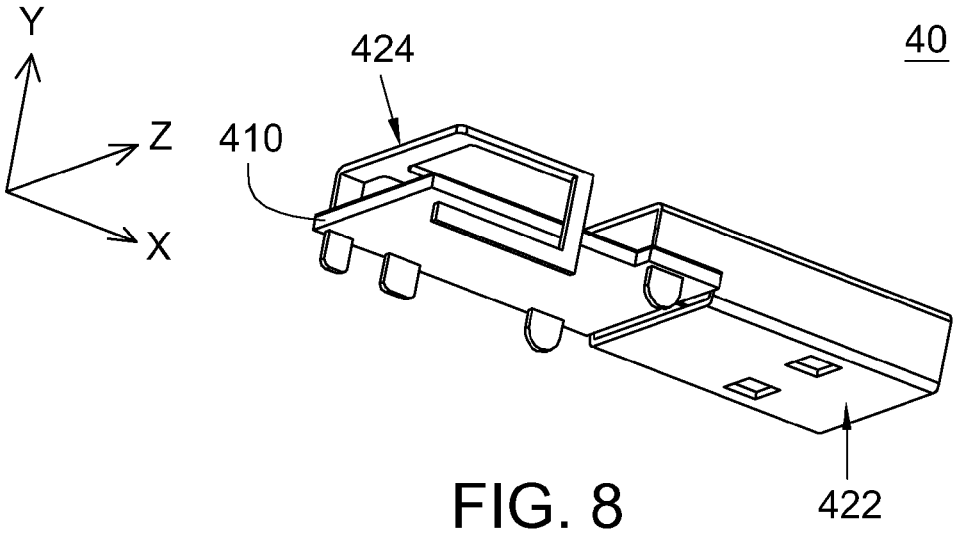

FIGS. 7 and 8 are schematic illustrations respectively showing a wireless network receiver 40 at different angles according to a first embodiment of the invention. Referring to FIGS. 7 and 8, the wireless network receiver 40 includes a circuit board 410 and a connector structure 420. The connector structure 420 is fixed on the circuit board 410 and includes a connector 422 and an antenna 424. The connector 422 and the antenna 424 are integrally formed as a whole. The antenna 424 is connected to one side of the circuit board 410 and crosses the circuit board 410. The width of the antenna 424 is smaller than or equal to the width of the connector 422. When the connector 422 is a universal serial bus (USB) connector, the width of the antenna 424 is smaller than or equal to 13 mm.

Because the connector 422 and the antenna 424 are integrally formed as a whole, no extra area of the circuit board has to be added to provide the printed antenna. Furthermore, because the connector 422 and the antenna 424 are integrally formed as a whole, it is unnecessary to manufacture a mold so that the extra cost of the mold can be eliminated. In addition, because the connector 422 and the antenna 424 are integrally formed as a whole, no extra assembling cost has to be spent.

Figure 9:
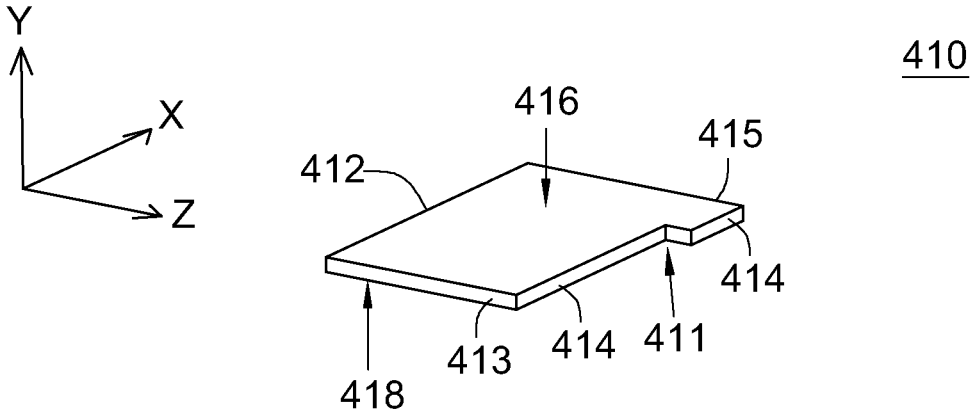
FIG. 9 is a schematic illustration showing a circuit board.

FIG. 9 is a schematic illustration showing the circuit board 410. Referring to FIGS. 7 and 9, the circuit board 410 further includes a sidewall 412, a sidewall 413, a sidewall 414, a sidewall 415, an upper surface 416 and a lower surface 418. The upper surface 416 and the lower surface 418 are disposed opposite and parallel to each other. The antenna 424 crosses the upper surface 416 and is parallel to the upper surface 416. The sidewalls 412, 413, 414 and 415 are vertically connected to the upper surface 416 and the lower surface 418. The sidewall 413 and the sidewall 415 are disposed opposite and parallel to each other. Two ends of the sidewall 412 and two ends of the sidewall 414 are vertically connected to two ends of the sidewall 413 and two ends of the sidewall 415. The sidewall 414 includes a notch 411. The antenna 424 extends from one side neighboring the sidewall 412 and crosses the upper surface 416 and the sidewall 414. For the sake of illustration, the direction vertically outputted (outward) from the upper surface 416 is defined as the Y direction, and the direction vertically inputted to (inward of) the sidewall 413 is defined as the X direction. In addition, the direction vertically inputted to (inward of) the sidewall 412 is defined as the Z direction. The X, Y and Z directions in the following description are made according to this definition.

Figure 10:
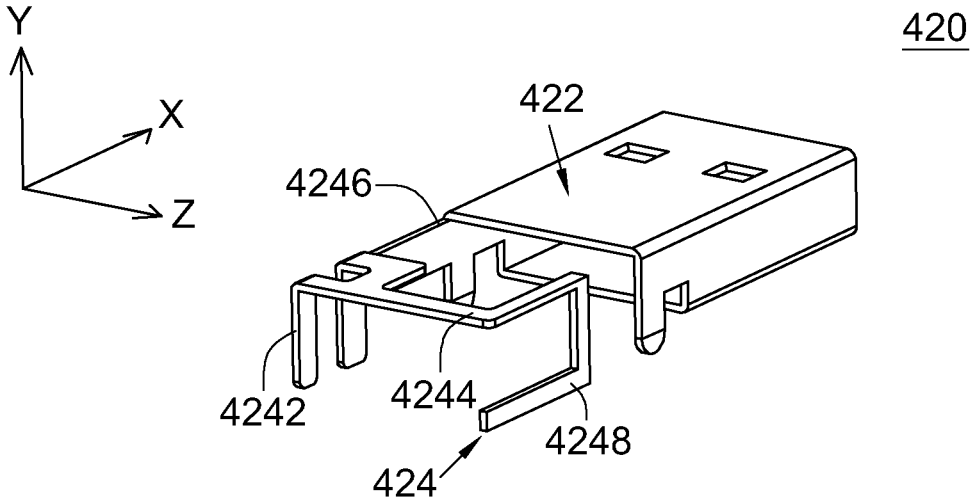
FIGS. 10 to 12 are schematic illustrations showing a connector structure at different angles according to the first embodiment of the invention.
Figure 11:
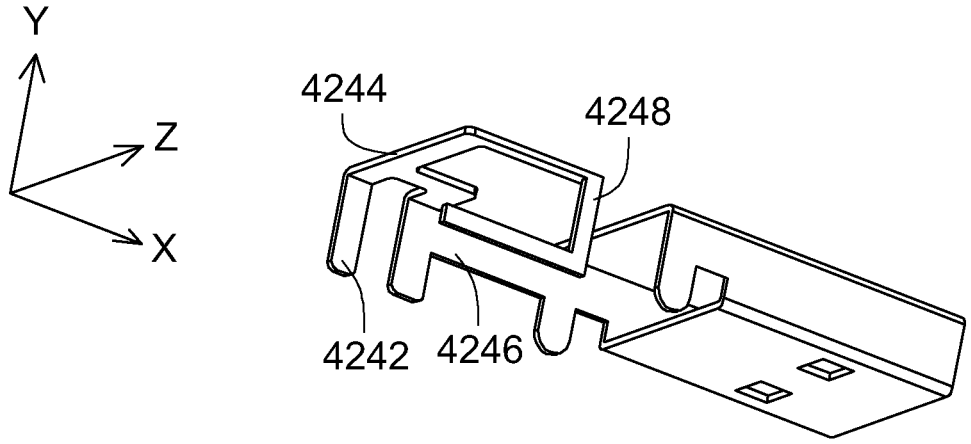
Figure 12:
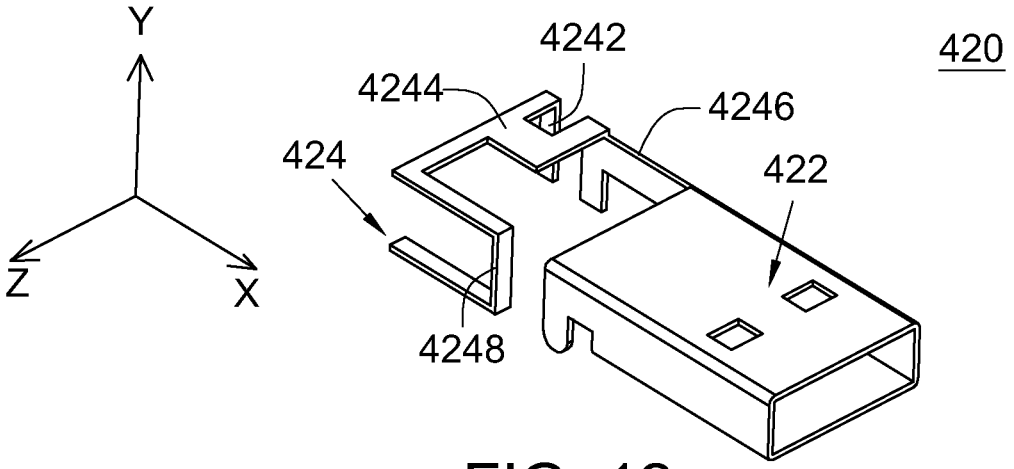

FIGS. 10 to 12 are schematic illustrations showing the connector structure at different angles according to the first embodiment of the invention. Referring to FIGS. 9 to 12, the antenna 424 further includes a feeding connecting member 4242, a horizontal radiator 4244, a vertical radiator 4248 and a grounding connecting member 4246. The feeding connecting member 4242 and the grounding connecting member 4246 neighbor one side of the sidewall 412, and the vertical radiator 4248 crosses the sidewall 414. The vertical radiator 4248 crosses the sidewall 414 through the notch 411. The feeding connecting member 4242 and the grounding connecting member 4246 are connected to the vertical radiator 4248 through the horizontal radiator 4244, and the horizontal radiator 4244 is connected to the connector 422 through the grounding connecting member 4246. The feeding connecting member 4242 feeds a signal, and the grounding connecting member 4246 is to be grounded. The horizontal radiator 4244 generates a horizontally polarized wave, and the vertical radiator 4248 perpendicular to the horizontal radiator 4244 generates a vertically polarized wave. The antenna 424 can generate the horizontally polarized wave and the vertically polarized wave, so it has the better radiation pattern, and the ability of receiving and transmitting the wireless signals can be significantly enhanced.

The feeding connecting member 4242, the grounding connecting member 4246 and the vertical radiator 4248 are perpendicular to the upper surface 416, while the horizontal radiator 4244 crosses the upper surface 416 and is parallel to the upper surface 416. The horizontal radiator 4244 includes at least one bend, such that the plane shape of the horizontal radiator 4244 becomes an h-like shape. The vertical radiator 4248 includes at least one bend, such that the vertical radiator 4248, after crossing the sidewall 414, parallelly extends along one side neighboring the sidewall 414 through the bend. In detail, the feeding connecting member 4242 and the grounding connecting member 4246 extend from one side neighboring the sidewall 412 in the direction (Y direction) vertically outputted from the upper surface 416. The horizontal radiator 4244 firstly extends in the direction (Z direction) vertically inputted to the sidewall 412 from the feeding connecting member 4242 and the grounding connecting member 4246, and then extends in the direction (X direction) vertically inputted to the sidewall 413. The vertical radiator 4248 firstly extends in the direction opposite the Y direction from the horizontal radiator 4244, and then in the direction opposite the X direction to form an L-shaped vertical radiator.

Figure 13:
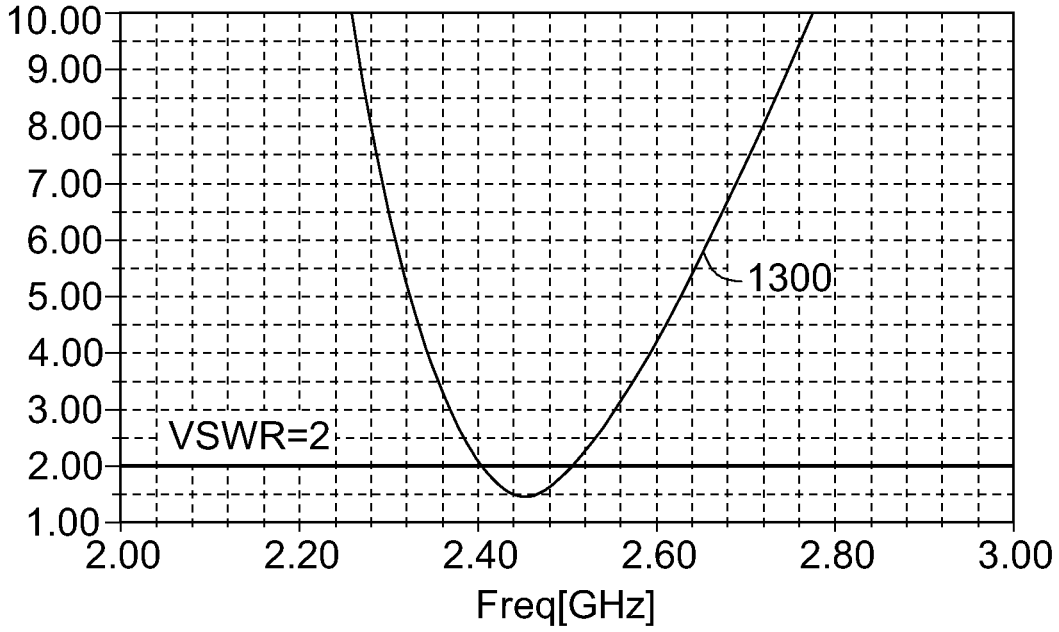
FIG. 13 is a simulated graph showing a voltage standing wave ratio of the wireless network receiver according to the first embodiment of the invention.

FIG. 13 is a simulated graph showing a voltage standing wave ratio of the wireless network receiver according to the first embodiment of the invention. The voltage standing wave ratio (VSWR) of the wireless network receiver is depicted as the profile 1300 of FIG. 13. The VSWR is an indicator unit for the consideration of the serious condition of the impedance mismatch. The smaller value of the VSWR represents that the impedance values of all sub-elements in this system are almost the same, that is, approach the perfect condition. According to the profile 1300 of FIG. 13, it is obtained that the VSWR of the wireless network receiver 40 in its operation frequency band is smaller than 2, so the transmission power is not significantly attenuated.

Second Embodiment

Figure 14:
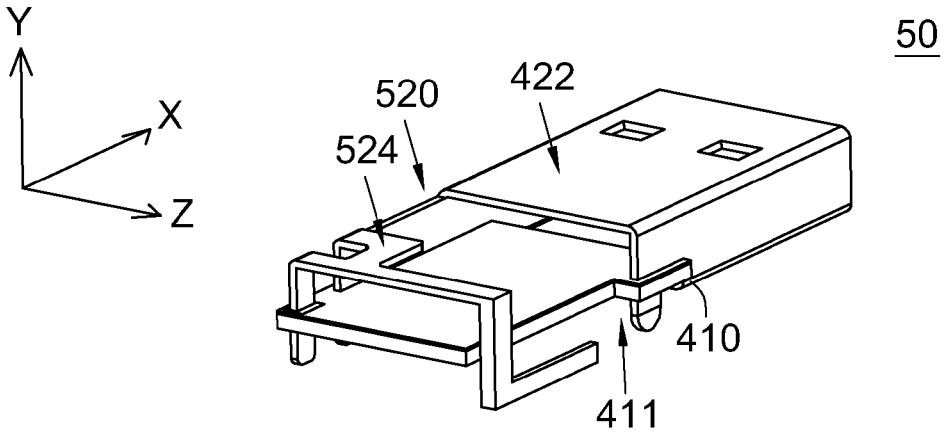
FIGS. 14 and 15 are schematic illustrations showing a wireless network receiver at different angles according to a second embodiment of the invention.
Figure 15:
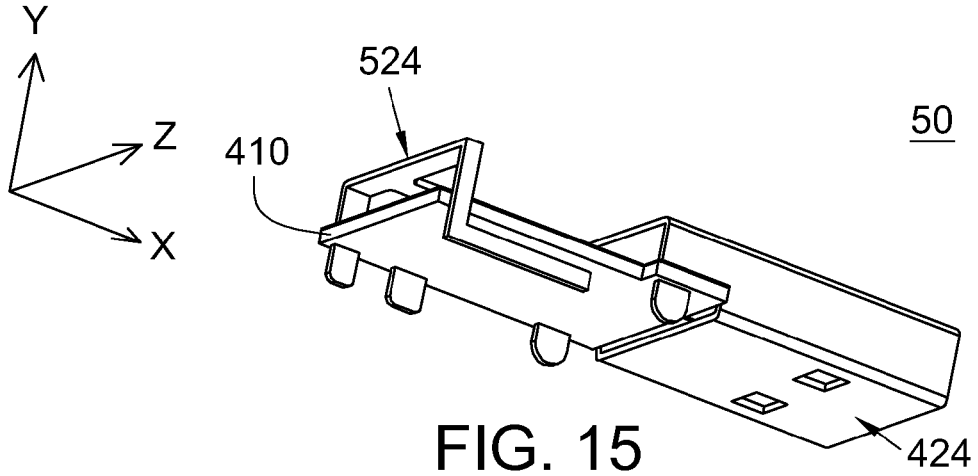
Figure 16:
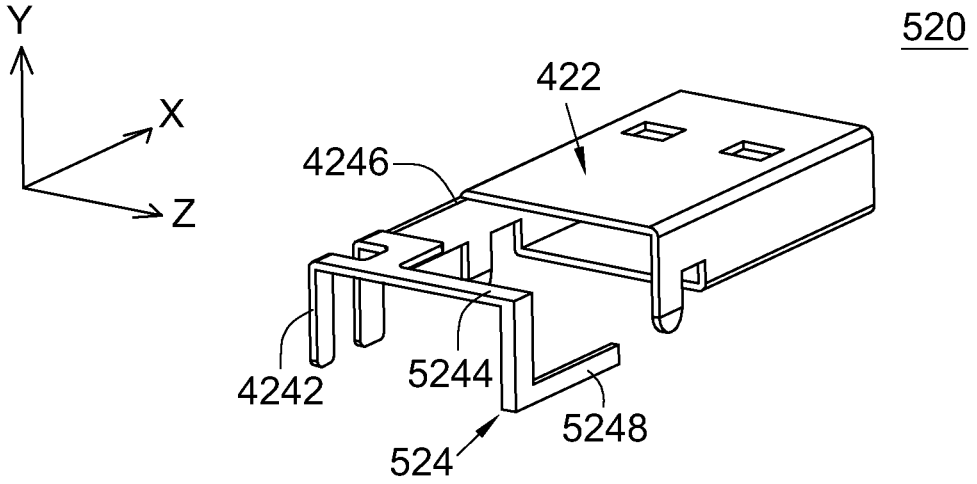
FIGS. 16 to 18 are schematic illustrations showing a connector structure at different angles according to the second embodiment of the invention.
Figure 17:
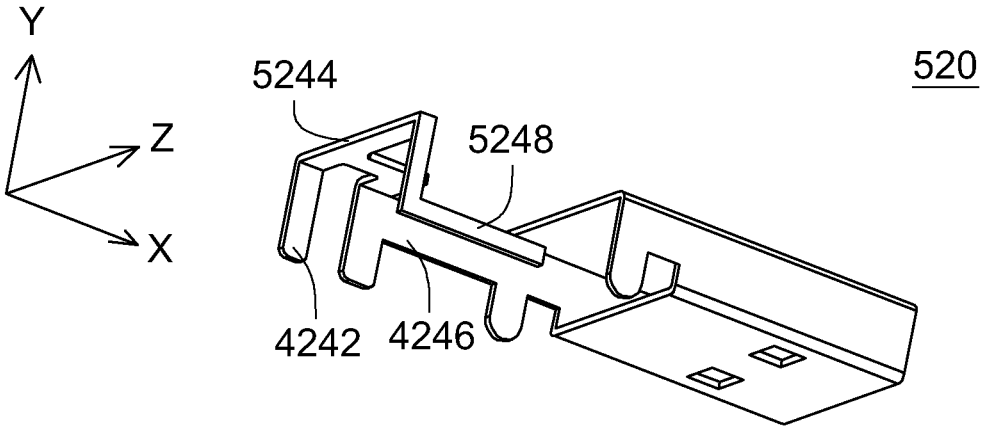
Figure 18:
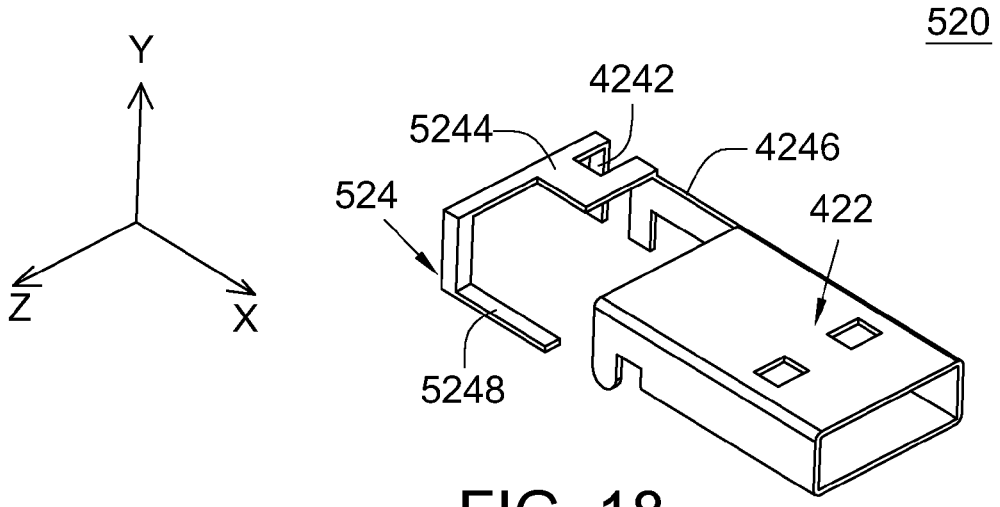

FIGS. 14 and 15 are schematic illustrations showing a wireless network receiver 50 at different angles according to a second embodiment of the invention. FIGS. 16 to 18 are schematic illustrations showing a connector structure 520 at different angles according to the second embodiment of the invention. As shown in FIGS. 9 and 14 to 18, the wireless network receiver 50 of the second embodiment differs from the wireless network receiver 40 of the first embodiment in that the connector structure 520 of the second embodiment is different from the connector structure 420 of the first embodiment.

A horizontal radiator 5244 of the connector structure 520 extends in the direction (Z direction) vertically inputted to the sidewall 412 from the feeding connecting member 4242 and the grounding connecting member 4246 to form an h-like shaped horizontal radiator, but does not extend in the X direction. A vertical radiator 5248 extends in the direction opposite the Y direction from the horizontal radiator 5244, and then extends in the direction (X direction) vertically inputted to the sidewall 413.

Third Embodiment

Figure 19:
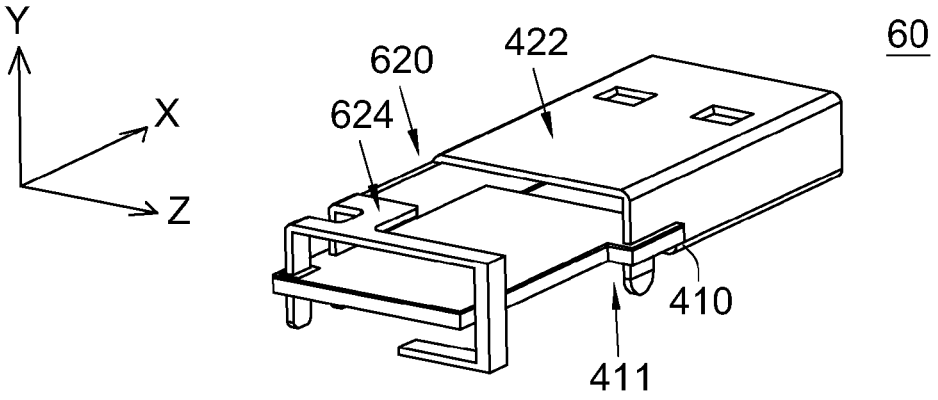
FIGS. 19 and 20 are schematic illustrations showing a wireless network receiver at different angles according to a third embodiment of the invention.
Figure 20:
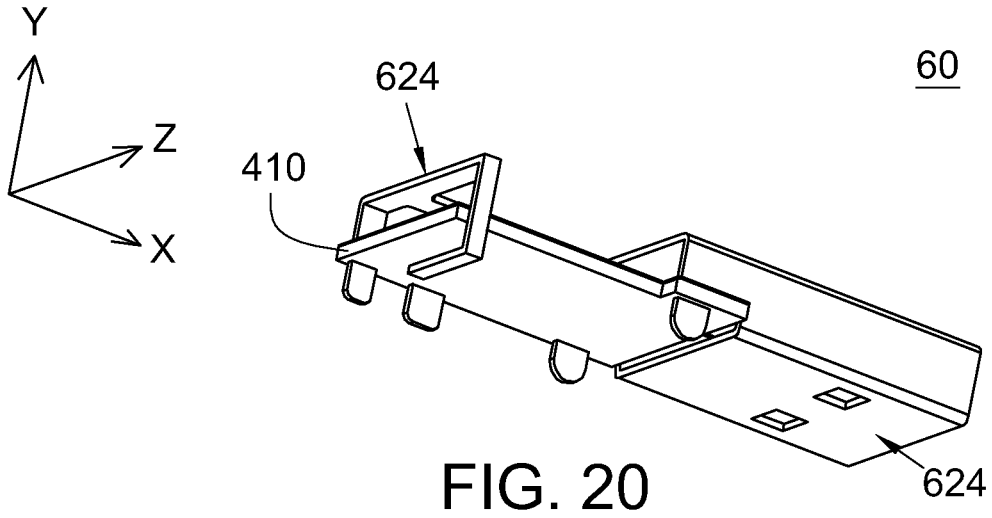
Figure 21:
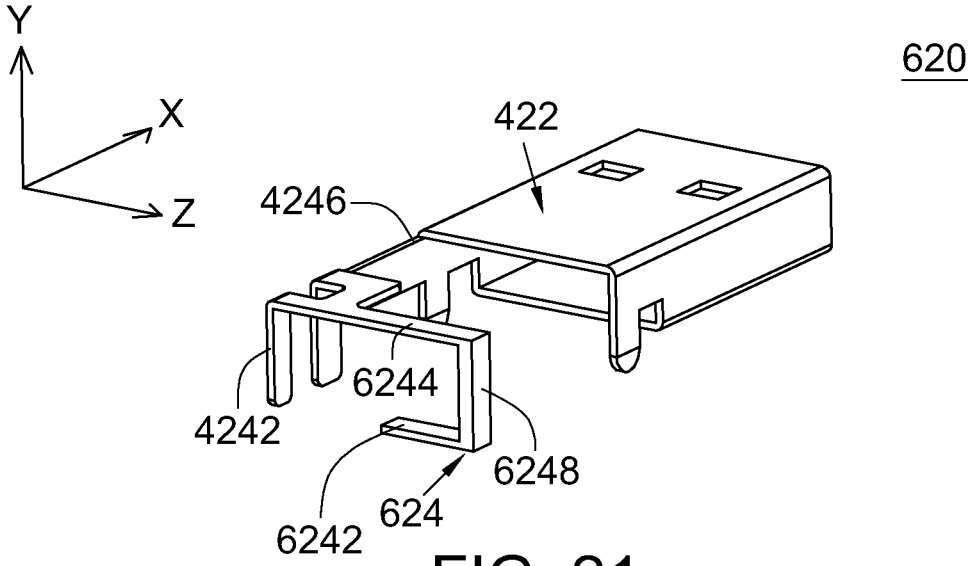
FIGS. 21 to 23 are schematic illustrations showing a connector structure at different angles according to the third embodiment of the invention.
Figure 22:
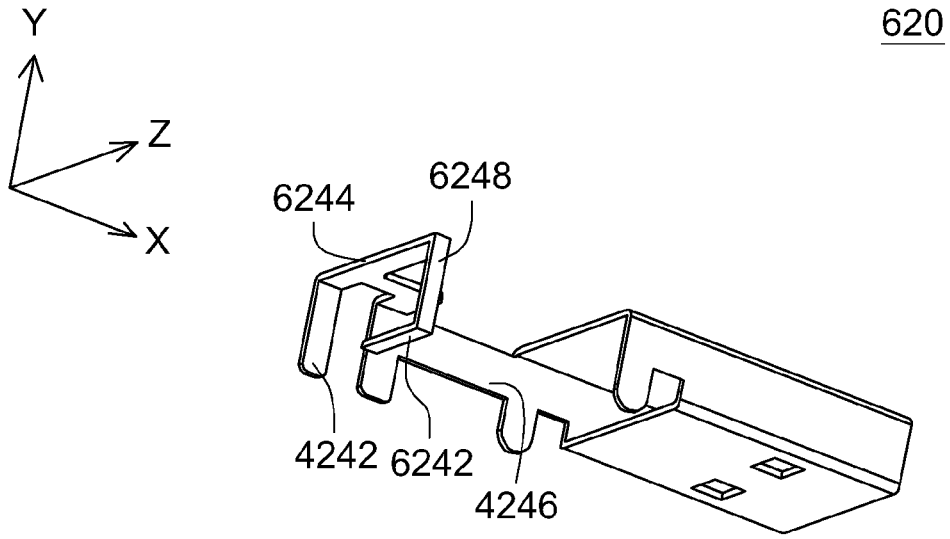
Figure 23:
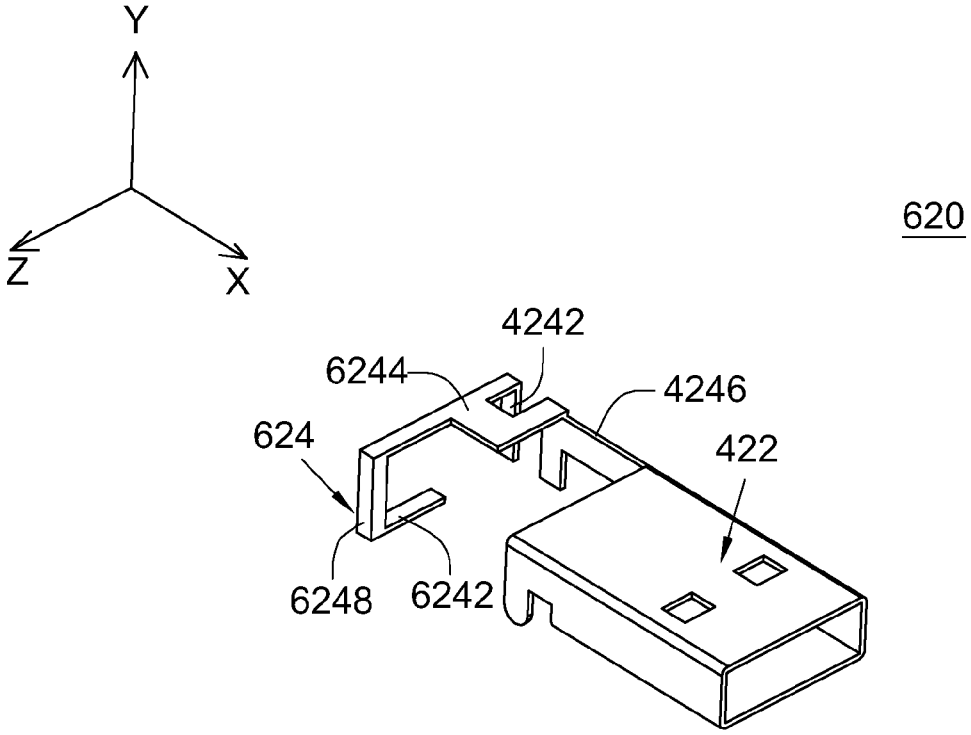

FIGS. 19 and 20 are schematic illustrations showing a wireless network receiver 60 at different angles according to a third embodiment of the invention. FIGS. 21 to 23 are schematic illustrations showing a connector structure 620 at different angles according to the third embodiment of the invention. As shown in FIGS. 9 and 19 to 23, the wireless network receiver 60 of the third embodiment differs from the wireless network receiver 50 of the second embodiment in that the connector structure 620 of the third embodiment is different from the connector structure 520 of the second embodiment.

A horizontal radiator 6244 of the connector structure 620 extends in the direction (Z direction) vertically inputted to the sidewall 412 from the feeding connecting member 4242 and the grounding connecting member 4246 to form an h-like shaped horizontal radiator, but does not extend in the X direction. A vertical radiator 6248 extends in the direction opposite the Y direction from the horizontal radiator 5244, but does not extend in the direction (negative Z direction) vertically inputted to the sidewall 414. An antenna 624 further includes a horizontal radiator 6242.

The vertical radiator 6248 extends in the direction opposite the Y direction from the horizontal radiator 6244, and the horizontal radiator 6242 further extends in the direction opposite the Z direction from the vertical radiator 6248. The direction opposite the Z direction is the direction vertically inputted to the sidewall 414.

The wireless network receiver according to each embodiment of the invention has many advantages, some of which will be listed in the following.

First, no extra cost for the mold is needed.

Second, no extra assembling cost is needed.

Third, no extra area of the circuit board has to be added.

Fourth, the better radiation pattern is possessed.

Fifth, the structure is simple, and the difficulty in manufacturing is relatively decreased.

While the invention has been described by way of example and in terms of the preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A wireless network receiver, comprising:

a circuit board, comprising an upper surface, a lower surface disposed opposite and parallel to the upper surface, a first sidewall, a second sidewall, a third sidewall and a fourth sidewall, wherein the first sidewall and the third sidewall are disposed opposite and parallel to each other, two ends of the second sidewall and two ends of the fourth sidewall are vertically connected to two ends of the first sidewall and two ends of the third sidewall, and the first sidewall, the second sidewall, the third sidewall and the fourth sidewall are vertically connected to the upper surface and the lower surface; and a connector structure fixed on the circuit board, the connector structure comprising:

a connector; and an antenna crossing the circuit board, where the antenna and the connector are integrally formed as a whole, and the antenna comprises:

a feeding connecting member;

a horizontal radiator, connected to the feeding connecting member, for generating a horizontally polarized wave;

a vertical radiator, connected to the horizontal radiator, for generating a vertically polarized wave; and a grounding connecting member for connecting the horizontal radiator to the connector, wherein the feeding connecting member and the grounding connecting member neighbor one side of the second sidewall, the vertical radiator crosses the fourth sidewall, and the circuit board is disposed between the vertical radiator and the feeding connecting member.

2. The wireless network receiver according to claim 1, wherein a width of the antenna is smaller than or equal to a width of the connector.

3. The wireless network receiver according to claim 1, wherein the connector is a universal serial bus (USB) connector.

4. The wireless network receiver according to claim 1, wherein the horizontal radiator is perpendicular to the vertical radiator.

5. The wireless network receiver according to claim 1, wherein the fourth sidewall further comprises a notch, and the vertical radiator crosses the fourth sidewall through the notch.

6. The wireless network receiver according to claim 1, wherein the feeding connecting member, the grounding connecting member and the vertical radiator are perpendicular to the upper surface.

7. The wireless network receiver according to claim 1, wherein the antenna crosses the upper surface and is parallel to the upper surface.

8. The wireless network receiver according to claim 1, wherein the horizontal radiator crosses the upper surface and is parallel to the upper surface.

9. The wireless network receiver according to claim 1, wherein the horizontal radiator further comprises at least one bend, so that a plane shape of the horizontal radiator is an h-like shape.

10. The wireless network receiver according to claim 1, wherein the vertical radiator further comprises at least one bend, so that the vertical radiator, after crossing the fourth sidewall, parallelly extends along one side neighboring the fourth sidewall through the bend.

11. The wireless network receiver according to claim 1, wherein the vertical radiator further comprises at least one bend, so that the vertical radiator, after crossing the fourth sidewall, parallelly extends along the lower surface through the bend.

12. The wireless network receiver according to claim 1, wherein the vertical radiator has an L-shape.

13. The wireless network receiver according to claim 1, wherein the feeding connecting member and the grounding connecting member extend in a first direction vertically outward from the upper surface from one side neighboring the second sidewall, the horizontal radiator extends in a second direction vertically inward of the second sidewall from the feeding connecting member and the grounding connecting member, and the vertical radiator extends in a direction opposite to the first direction from the horizontal radiator.

14. The wireless network receiver according to claim 13, wherein the horizontal radiator further extends in a third direction vertically inward of the first sidewall.

15. The wireless network receiver according to claim 14, wherein the vertical radiator extends in the direction opposite to the first direction from the horizontal radiator, and then extends in a direction opposite to the third direction.

16. The wireless network receiver according to claim 13, wherein the antenna further comprises:

another horizontal radiator extending in a direction opposite to the second direction from the vertical radiator.

17. The wireless network receiver according to claim 13, wherein the vertical radiator extends in the direction opposite to the first direction from the horizontal radiator, and then extends in a third direction vertically inward of the first sidewall.

* * * * *